United States Patent [19]

Hudson

[11] 3,973,517

[45] Aug. 10, 1976

[54] DEVELOPMENT DEVICE AND METHOD

[75] Inventor: Frederick W. Hudson, West Henrietta, N.Y.

[73] Assignee: Xerox Corporation, Stamford, Conn.

[22] Filed: Feb. 18, 1975

[21] Appl. No.: 550,339

[52] U.S. Cl. ..... 118/637; 118/312; 427/21

[51] Int. Cl.[2] ..... G03G 15/08

[58] Field of Search ..... 118/637, DIG. 5, 429, 118/309, 634, 312; 427/21, 185

[56] References Cited

UNITED STATES PATENTS

| | | | |
|---|---|---|---|
| 2,310,894 | 2/1943 | Brusset | 118/DIG. 5 |
| 3,008,826 | 11/1961 | Mott et al. | 118/637 |
| 3,393,663 | 7/1968 | Donalies | 118/637 |
| 3,611,991 | 10/1971 | Young | 118/637 |
| 3,633,544 | 1/1972 | Weiler | 427/21 |
| 3,670,701 | 6/1972 | Weiler | 118/637 |
| 3,754,531 | 8/1973 | Donalies | 118/637 |

*Primary Examiner*—Mervin Stein
*Assistant Examiner*—Douglas Salser
*Attorney, Agent, or Firm*—James J. Ralabate; Michael H. Shanahan; George J. Cannon

[57] ABSTRACT

A development method and device for developing a latent image wherein an irregular surfaced vibrating bed transports toner particles from a supply area to the development area.

18 Claims, 4 Drawing Figures

DEVELOPMENT DEVICE AND METHOD

BACKGROUND OF THE INVENTION

This invention relates to image development and more particularly relates to the dry development of latent images.

In the practice of image development a latent image pattern on a substrate is dusted or toned with finely divided attractable powder to produce a visible image. In most instances the attracted toner is subsequently transferred to a final image substrate and the latent image is again toned to provide multiple copies. The means for bringing the toner particles into contact with the latent image usually involves either immersing the latent image bearing surface in a bath of toner particles or toner particles are cascaded or flung toward the image bearing surface so as to impinge upon said surface.

A major problem encountered in the magnetic and electrostatic imaging processes is the unwanted adherence of toner particles in non-image areas of the surface carrying the latent image. The unwanted toner is termed "background" and its presence degrades the image quality of the copies produced by the imaging process. The development systems of the prior art place toner into contact with all areas of the surface carrying the latent image and thus provide the opportunity for toner particles in background areas to remain there due to one or more reasons, some not yet understood.

Accordingly, there is a need for a development system which brings toner particles to the latent image in large quantity yet gently so as to reduce the opportunity for the particles to adhere to the surface in background areas.

SUMMARY OF THE INVENTION

One of the objects of this invention is to provide a development system for developing latent magnetic and electrostatic images which reduces the opportunity for background deposit of the toner particles.

Another object of this invention is to provide a development system capable of recirculating the toner particles from the development area to the toner supply area.

Another object of this invention is to provide a simple and convenient development system and method.

Another object of this invention is to provide a development system for developing magnetic images which brings toner particles into the vicinity but not into contact with the magnetic surface bearing the latent image.

These and other objects will be apparent from the following description of the invention.

According to this invention there is provided a development system comprising an irregular surfaced vibrating bed which carries toner particles from a toner supply area to the vicinity of a latent image such that the particles are attracted to the latent image but are not attracted in background areas.

In another embodiment the development system of this invention comprises a saw-toothed vibrating bed inclined at an upward angle from the horizontal. The surface bearing the latent image is also inclined so as to be in a plane approximately parallel to the plane of the vibrating bed. Below the upper end of the saw-toothed bed there is provided a toner collecting bin having an inclined bottom portion which funnels the unused toner conveyed by the saw-toothed bed back to the toner supply area for reuse in the development system.

DETAILED DESCRIPTION OF THE DRAWINGS

Figure 1A:
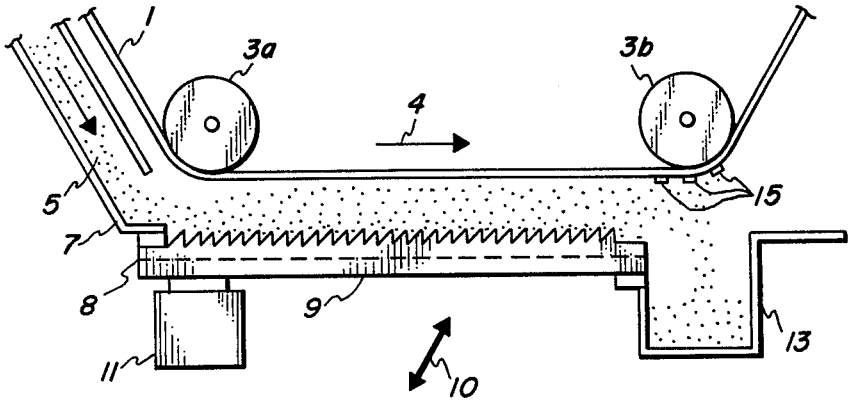
FIG. 1*a* is a side elevation of the development system of this invention in the horizontal configuration.

In FIG. 1 there is shown a latent image bearing substrate 1 entrained over rollers 3*a* and 3*b*. The substrate moves over rollers 3*a* and 3*b* in the direction shown by arrow 4. Toner particles 5 are fed from toner supply means 7 onto the irregular surface of vibrating bed 9. Vibrating means 11 imparts a vibratory motion to bed 9 in an angular direction to the longitudinal axis of bed 9, generally indicated by double headed arrow 10. The irregular surface of bed 9 provides plane surfaces facing toward the end of bed 9 opposite the toner supply means. The angular vibratory motion imparted to the bed cooperates with the irregular surface to achieve propulsion of particles 5 in the desired direction toward substrate 1 and said opposite end of bed 9. While any pattern of irregularity can be employed, typically the bed surface contains grooves in a direction normal to the longitudinal axis of the bed. By adjusting the amount of vibration in bed 9 and the distance to the substrate 1, the trajectory of toner particles 5 is set so as to approach the vicinity of the surface of substrate 1 or to impinge upon said surface gently with minimum impact.

Toner particles 5 which are propelled into the vicinity of the attractive forces of the latent image on substrate 1 are attracted and held on the surface of substrate 1. Those particles propelled to the background area of the surface fall back to the vibrating bed 9. Toner particles returned to bed 9 are again propelled toward substrate 1 until either being attracted by the forces of the latent image or until they reach the end of bed 9 whereupon the toner is deposited into collection bin 13. The angular vibratory motion imparted to bed 9 maintains the direction of toner particles 5 in a progressive movement pattern toward collector bin 13. As substrate 1 leaves the development area it carries with it the attracted toner particles 5 in imagewise configuration generally noted as image areas 15 in FIG. 1.

When the latent image force is magnetic, toner particles 5 are finely divided magnetic particles such as iron oxide, chromium oxide or these and other such magnetically attractable material dispersed in a plastic material. Typical plastic materials include polystyrene resin, acrylic resin, polyethylene resin, polyvinylchloride resin, polyacrylamide resin, methacrylate resin, polyethelene terephthalate resin, polyamide resin as well as many other resins. Typical magnetic toner compositions, by tradename, include Magni-dri type 355 and Color-in-Color Toner available from 3M Co., St. Paul, Minn. and DI-TM-A magentic toner available from Data Interface Corp., Danburg, Conn.

Figure 1B:
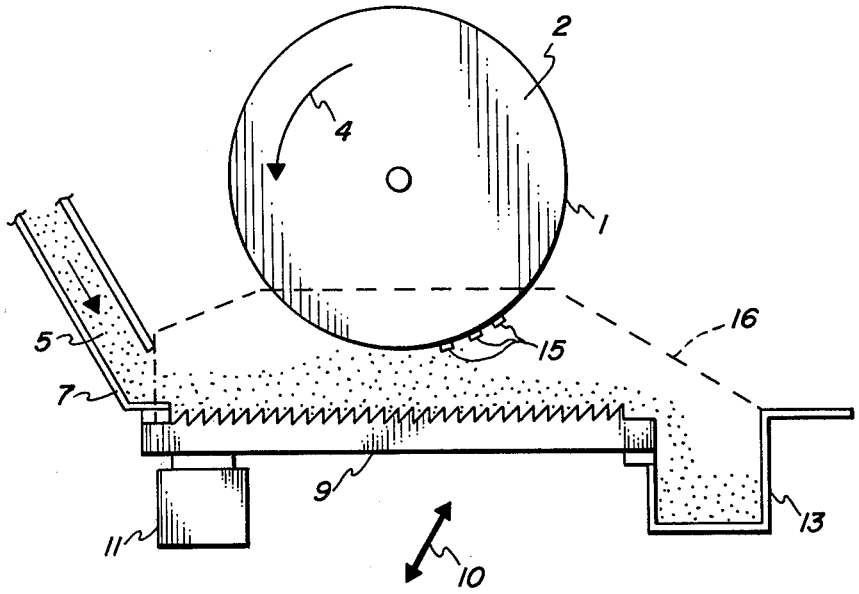
FIG. 1*b* illustrates the apparatus of this invention wherein the substrate bearing the latent image is cylindrical.

The apparatus of this invention can be employed to develop latent electrostatic images in which case toner alone or toner with carrier, well known in the art of xerography, can be employed in place of the magnetic toner. In FIG. 1*b* the apparatus of FIG. 1*a* is illustrated but wherein the latent image bearing surface 1 is in the form of cylinder 2. While not preferred, the apparatus of this invention can be employed in this configuration but the development zone made available to the toner particles 5 from bed 9 is much more limited than the configuration in FIG. 1*a*. The reference numerals in FIG. 1*b* are otherwise identical to those described above with respect to FIG. 1*a*.

Figure 2:
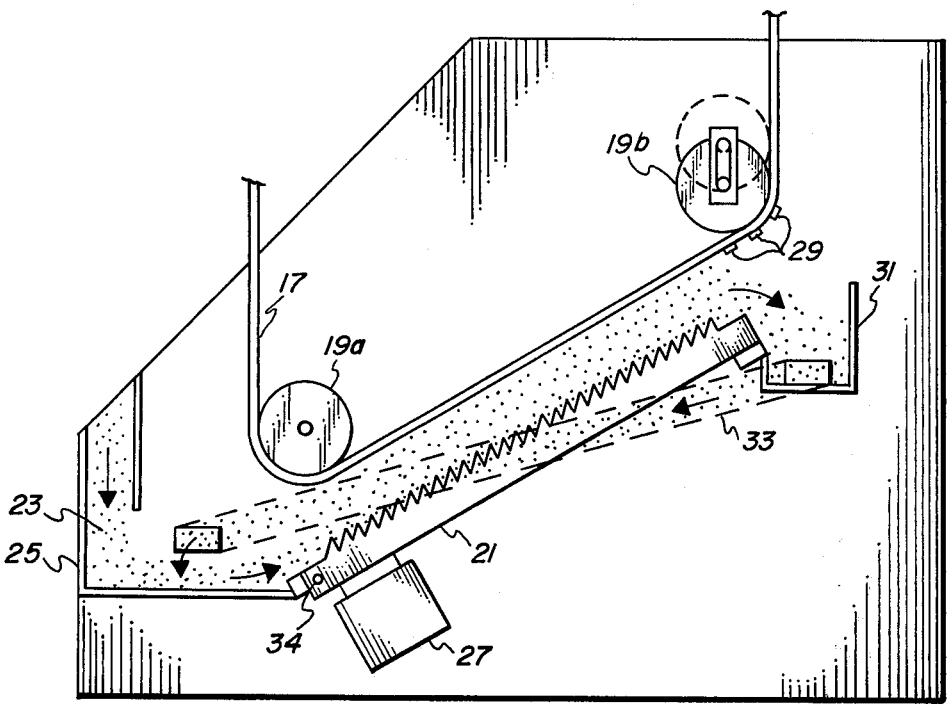
FIG. 2 is a side elevation of the development system of this invention wherein the vibrating saw-toothed bed is raised at an angle from the horizontal.

In FIG. 2 another embodiment of the apparatus of this invention is diagrammatically represented. In this embodiment, substrate 17 carries a latent image over rollers 19*a* and 19*b* at an angle to the horizontal plane. The angle formed with the horizontal is typically in the range of from about 10° to about 40° and preferably about 25°. Vibrating bed 21 is also inclined so as to be substantially parallel to substrate 17. Toner particles 23 are fed from supply means 25 onto vibrating bed 21 actuated by vibrator 27. The irregular surface of vibrating bed 21, preferably a saw-toothed pattern, accepts toner particles 23 and propels them toward the surface of substrate 17 and toward the open end of vibrating bed 21. The saw-tooth pattern provides a substantial change in the effective angle of the bed and prevents toner particles 23 from falling back toward supply means 25. As in FIG. 1 above, the toner particles are propelled in a trajectory which brings them into gentle impingement with substrate 77 or within the attractive forces of the latent image on substrate 17. The attractive forces of the latent image hold the particles of toner. The developed image is indicated by image portions 29 emerging from the development zone.

Toner particles 23 not attracted by the latent image, are propelled over the open end of vibrating bed 21 into collector bin 31. By means of optional conduit 33 leading from collector bin 31 to toner supply means 25 the unused toner is automatically recycled without the need of mechanical conveying means independent of gravitational forces. In one embodiment the vibratory motion imparted to bed 21 can also be imparted to conduit 33 so as to aid in the flow of unused toner from collector bin 31 to supply means 25.

Figure 3:
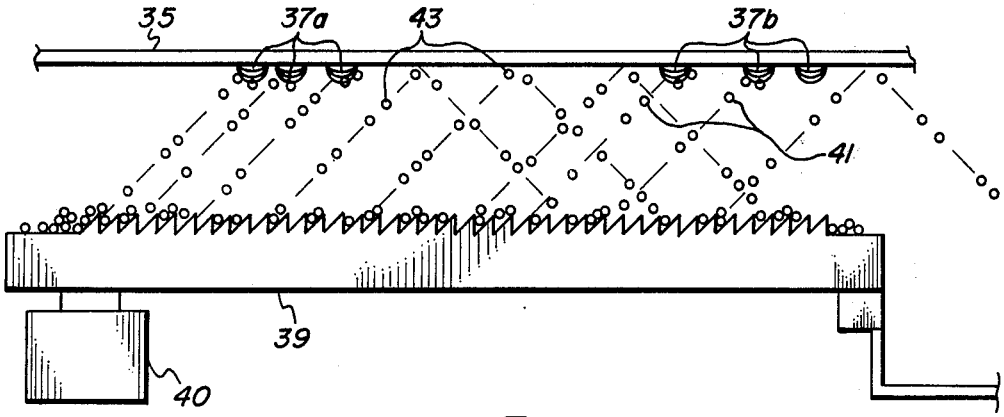
FIG. 3 is a greatly expanded diagrammatical side view of the development area between the saw-toothed bed and the surface bearing the latent image.

To more particularly point out the toning method and apparatus of this invention, there is shown in FIG. 3 a greatly expanded view of the area between the vibrating bed and the latent image bearing substrate. In FIG. 3 substrate 35 carries a latent image represented by lines of force 37*a* and 37*b*. Vibrating bed 39 propels toner particles 41 into the area of attractive force 37*a* and 37*b* whereupon the particles are held by said force in conformance with the image pattern. Particles 43 are shown being propelled from vibrating bed 39 to an area in the vicinity of substrate 35 which contains no forces of the latent image and thus the particles return to bed 39 by gravitational force to be again propelled toward the substrate 35. Dense loading of toner accumulates in the cuts of bed 39 thus allowing for a continuous supply of toner to be propelled toward the substrate 35 throughout the length of bed 21. Each cut acts in the manner of an individual weir to control the flow of toner through the development zone.

By adjusting vibrator means 40, toner particles are made to avoid impingement of substrate 35 or to impinge only lightly thus affording less opportunity for unwanted background on substrate 35. Typically, the vibrating bed is placed apart from the substrate bearing the latent image in a range of from about 0.01 to about 0.05 inch.

One of the advantageous features of the apparatus of this invention is the control one can exercise over the supply of toner particles to the latent image to be developed. For example, in the embodiment described in FIG. 2, the ascension rate of the toner particles is controlled by several means. Preferably, the device is so constructed that the angle of inclination of bed 21 is adjustable by mounting bed 21 on a pivot means 34. Roller 19*b* is made vertically adjustable so as to maintain a substantially parallel relationship between bed 21 and substrate 17. More particularly, the ascension rate and the distance above the bed toner particles rise, are in, general, regulated by the amount and angle of impact between the toner particles and the vibrating bed. The angle of impact is determined by the combined effect of the angle of vibratory motion, angle of inclination of the bed and the bed surface angle created by the irregularities therein, that is, the angle of incline between each groove on the surface. In a saw tooth pattern the angle of incline is the ramp angle of the individual groove or tooth. The amount of impact is determined by the amplitude of vibratory motion imparted to bed 21. The grooves formed by the irregular surface of the bed collect toner particles proportional to their depth and thus the amount of toner available in the development zone is generally regulated by such depth. The irregular surface can be made in an interchangeable plate which is affixed to the vibrating bed. In this embodiment the pattern of irregularity, including the depth of the grooves and angle of the planar surfaces referred to above can be modified in an imaging apparatus containing the development system of this invention. Such an embodiment is illustrated in FIG. 1*a* by dotted line 8 in bed 9. The plate can be affixed to bed 9 by and retaining means such as screws through the top surface of the plate or by clamps on the edges thereof. The number of steps may vary greatly, such as from 4 to 32 per inch while eight steps per inch is preferred. In most commercially available vibrator means the amplitude of vibration is adjustable in the range of from 0 to 2.4 mm. A typical operating setting is a frequency of 120 cycles per second at an amplitude of 1.5 mm. Materials of construction are not critical for the vibrating bed and metal such as aluminum, brass or stainless steel are preferred for use in the development of magnetic images. Ferrous metals can be employed in the case of electrostatic development.

Toner movement rates over the irregular surface are exemplified by the data in Table I below. Magni-dri type 355 toner was employed with a vibrating bed driven by a Syntron vibrator manufactured by FMC Corp., Homer City, Pennsylvania at 106 volts AC. The amount of toner delivered by the bed in terms of grams per centimeter per second are given. The vibrating bed was equipped with side plates on each side to prevent toner spill over the edges of the bed. Such optional side plates are shown in dotted lines 16 of FIG. 1*b*. For cleanliness during actual operations one may prefer to employ such side plates affixed to each side of the vibrating bed. As in any toning apparatus, there is provided seal means around the development means for the purpose of retaining the finely divided toner particles. As is known in the art, such seal means are critical at the entry and exit points of the substrate bearing the latent image. The above mentioned side plates can be included as part of said seal means by bringing them into contact with said substrate as shown in FIG. 1*b*. As is known in the art a resilient gasket is employed at the contact points.

Table I

| Angles | | | Groove | | |
|---|---|---|---|---|---|
| Bed Inclination | Ramp | Vibrator | Depth (in) | No./in. | Transport Rate |
| 10° | 10° | −10° | .043 | 4 | .65 |
| 10° | 10° | 0° | .043 | 4 | .13 |
| 10° | 10° | +10° | .043 | 4 | .38 |
| 10° | 10° | −10° | .011 | 4 | .79 |
| 10° | 10° | 0° | .011 | 4 | .20 |
| 10° | 10° | +10° | .011 | 4 | .074 |
| 10° | 10° | −10° | .022 | 4 | .72 |
| 10° | 10° | 0° | .022 | 4 | .21 |
| 10° | 10° | +10° | .022 | 4 | .066 |

As indicated by the data in Table I above, the rate of toner flow through the development zone is controlled over a wide range. Other flow rates can be achieved by varying other controllable parameters such as bed inclination, planar surface angle and number of groove per inch in the bed.

A preferred embodiment of this invention is a process wherein the latent image on the substrate is magnetic and the developed image is transferred such as by pressure or by electrostatically charging and transferring the image to a second substrate. The magnetic image is then free to be redeveloped so as to provide multiple copies in a cyclical system. In the embodiment of this invention wherein the latent image is electrostatic in nature, such as in the xerographic art, a cylindrical or belt system is employed. As is well known, the developed image is electrostatically transferred from the latent image bearing substrate and said substrate is cleaned, recharged, reexposed and again developed in accordance with this invention to provide multiple images. The process of this invention provides rapid development and can therefore be used with the most modern processes for high speed production of multiple images.

It is to be understood that the invention is not to be limited to the exact details of operation or exact embodiments shown and described above. Obvious modifications and equivalents will be apparent to one of ordinary skill in the art and the invention is therefore to be limited only by the scope of the appended claims.

What is claimed is:

1. A development system wherein a latent image on a substrate is developed by particulate toner comprising a bed having an irregular surface, means to impart an angular vibrating motion to said bed, toner supply means positioned to supply toner particles to said irregular surface at one end of said bed, said bed being spaced apart from said substrate whereby said toner is propelled toward said substrate and the other end of said bed, the amplitude of vibration and said bed space between said substrate and bed is adjusted to allow the trajectory of the majority of said toner to approach said substrate without impingement thereon.

2. The system of claim 1 wherein said substrate is flexible and entrained over two rollers.

3. The system of claim 1 wherein said irregular surface is a saw-tooth pattern.

4. The system of claim 1 wherein a collector bin is positioned at said other end of said bed to collect unused toner propelled from said bed.

5. The system of claim 1 wherein said latent image is a magnetic latent image and said toner is magnetically attractable.

6. The system of claim 1 wherein said latent image is an electrostatic image and said toner is electrostatically attractable by said image.

7. The system of claim 1 wherein said vibration means oscillates at a rate of up to about 120 cycles per second.

8. The system of claim 3 wherein said bed contains from about four to about 32 teeth per inch.

9. The system of claim 1 wherein said substrate is mounted on a cylindrical support.

10. A development system wherein a latent image on a substrate is developed by particulate toner comprising a bed having an irregular surface, said bed situated at an upward angle from the horizontal, means to impart an angular vibratory motion to said bed, a toner supply means positioned at one end of said bed to provide particulate toner to said irregular surface, said bed being spaced apart but substantially parallel to said substrate, whereby said toner is propelled towards said substrate and the other end of said bed, a collector bin at said opposite end of said bed to collect unused toner propelled from said bed, and a conduit connecting said bin with said toner supply means whereby unused toner from said bed is returned to said supply means.

11. The system of claim 10 wherein said latent image is magnetic.

12. The system of claim 11 wherein said substrate is a flexible web entrained over a pair of rollers.

13. The system of claim 10 wherein at least a portion of said vibrating motion is imparted to said conduit.

14. The system of claim 10 wherein said irregular surface is in the form of a saw-tooth pattern.

15. The system of claim 14 wherein said pattern contains from about four to about 32 teeth per inch.

16. The system of claim 10 wherein the space between said bed and said substrate is in the range of from about 0.01 to about 0.05 inch.

17. In a magnetic imaging apparatus wherein a latent magnetic image is created on a magnetic substrate and developed with particulate toner, the improvement wherein said development is obtained by means of the apparatus of claim 1.

18. In an electrostatic imaging apparatus wherein a latent electrostatic image is created on a substrate and developed with particulate toner, the improvement wherein said development is obtained by means of the apparatus of claim 1.

* * * * *